US007717289B2

(12) United States Patent
Yang et al.

(10) Patent No.: US 7,717,289 B2
(45) Date of Patent: May 18, 2010

(54) ANCHOR FOR LIQUEFIED NATURAL GAS STORAGE TANK

(75) Inventors: Young Myung Yang, Songnam (KR); Ihn Soo Yoon, Songnam (KR); Ji Hoon Kim, Songnam (KR); Byoung Taek Oh, Songnam (KR); Young Kyun Kim, Songnam (KR)

(73) Assignee: Korea Gas Corporation, Songnam (KR)

( * ) Notice: Subject to any disclaimer, the term of this patent is extended or adjusted under 35 U.S.C. 154(b) by 509 days.

(21) Appl. No.: 11/669,384

(22) Filed: Jan. 31, 2007

(65) Prior Publication Data

US 2008/0053993 A1 Mar. 6, 2008

(30) Foreign Application Priority Data

Sep. 1, 2006 (KR) ..... 10-2006-0084298
Sep. 1, 2006 (KR) ..... 10-2006-0084299

(51) Int. Cl.
*F17C 1/00* (2006.01)
*F17C 1/02* (2006.01)
*F17C 1/08* (2006.01)

(52) U.S. Cl. ..... 220/560.07; 220/560.1; 220/560.15; 220/592.26; 220/919; 220/921

(58) Field of Classification Search ..... 114/74 A; 220/23.89, 560.04, 560.05, 560.07, 560.1, 220/560.15, 592.25, 592.26, 592, 592.05, 220/627, 918, 919, 921
See application file for complete search history.

(56) References Cited

U.S. PATENT DOCUMENTS 2,006,331 A * 6/1935 Swearingen ..... 220/560.05
2,100,895 A * 11/1937 Austin ..... 220/567.2
2,545,686 A * 3/1951 Collins ..... 220/560.05
3,064,612 A * 11/1962 Gardner et al. ..... 114/74 A
3,114,470 A * 12/1963 McDill ..... 220/560.06
3,280,778 A * 10/1966 Leathard ..... 114/74 A
3,425,583 A * 2/1969 Bridges ..... 220/560.05
3,428,205 A * 2/1969 Basile et al. ..... 220/560.07
3,485,409 A * 12/1969 Becker ..... 220/560.07
3,498,249 A * 3/1970 Jones ..... 114/74 A
3,507,242 A * 4/1970 Ulbricht ..... 114/74 R
3,721,362 A * 3/1973 Bridges et al. ..... 220/560.06
3,723,231 A * 3/1973 Clay et al. ..... 428/86

(Continued)

FOREIGN PATENT DOCUMENTS

GB 1409265 A * 10/1975

(Continued)

*Primary Examiner*—Anthony Stashick
*Assistant Examiner*—Ned A Walker

(57) ABSTRACT

An LNG storage tank comprises a heat insulating wall on an inner surface of the storage tank, a sealing wall contacting LNG on the heat insulating wall, and a structure to support the sealing wall. The structure comprises an anchor structure, which comprises an anchor member between the inner surface of the storage tank and the sealing wall to secure the sealing wall to the inner surface, and a heat-insulating material around the anchor member. The anchor member is coupled at several portions to the inner surface. The structure provides a simple configuration to the heat insulating wall and the sealing wall, and a simple connection therebetween, enabling convenient construction thereof while increasing sealing reliability. The structure simplifies an assembled structure and a manufacturing process, reducing a construction time of the tank while efficiently relieving stress on the tank.

11 Claims, 8 Drawing Sheets

U.S. PATENT DOCUMENTS 3,754,675 A * 8/1973 Richard et al. ..... 220/560.06
3,767,150 A * 10/1973 Tabata ..... 248/146
3,800,970 A * 4/1974 Jackson ..... 220/560.08
3,806,391 A * 4/1974 Clay et al. ..... 156/279
3,811,593 A * 5/1974 Bridges et al. ..... 220/560.07
3,830,396 A * 8/1974 Jackson ..... 220/560.07
3,839,981 A * 10/1974 Gilles ..... 114/74 A
3,908,574 A * 9/1975 Miller et al. ..... 114/74 R
3,944,106 A * 3/1976 Lamb ..... 220/4.12
3,974,935 A * 8/1976 Ffooks ..... 220/560.05
4,000,711 A * 1/1977 Okamoto et al. ..... 114/74 A
4,003,174 A * 1/1977 Kotcharian ..... 52/415
4,013,030 A * 3/1977 Stafford ..... 114/74 A
4,021,982 A * 5/1977 Kotcharian ..... 52/410
4,039,708 A * 8/1977 Okada ..... 428/73
4,057,943 A * 11/1977 Lienhard ..... 52/126.6
4,099,649 A * 7/1978 Guilhem et al. ..... 220/560.07
4,155,482 A * 5/1979 Swaney ..... 220/560.15
4,156,492 A * 5/1979 Cavanna et al. ..... 220/560.1
4,173,936 A * 11/1979 Secord et al. ..... 114/74 A
4,182,254 A * 1/1980 Secord ..... 114/74 A
4,225,054 A * 9/1980 Jean ..... 220/592.2
4,374,478 A * 2/1983 Secord et al. ..... 73/863.31
4,469,594 A * 9/1984 Poetter ..... 210/108
4,487,332 A * 12/1984 Huang ..... 220/560.1
4,561,292 A * 12/1985 Pugnale et al. ..... 73/49.2
4,676,093 A * 6/1987 Pugnale et al. ..... 73/49.2
4,696,240 A * 9/1987 Maxeiner ..... 109/82
4,747,513 A * 5/1988 Betille et al. ..... 220/560.12
4,781,777 A * 11/1988 Pugnale et al. ..... 156/187
5,012,948 A * 5/1991 Van Den Bergh ..... 220/560.05
5,054,645 A * 10/1991 Sharp ..... 220/560.03
5,269,247 A * 12/1993 Jean ..... 114/74 A
5,368,670 A * 11/1994 Kauffman ..... 156/171
5,447,112 A * 9/1995 Jean ..... 114/74 A
5,450,806 A * 9/1995 Jean ..... 114/74 A
5,462,191 A * 10/1995 Bartlow et al. ..... 220/62.11
5,470,041 A * 11/1995 Cucinotta ..... 248/349.1
5,531,178 A * 7/1996 Abe et al. ..... 114/74 A
5,620,110 A * 4/1997 Delatte ..... 220/560.1
5,727,492 A * 3/1998 Cuneo et al. ..... 114/74 A
6,035,795 A * 3/2000 Dhellemmes et al. ..... 114/74 A
6,047,747 A * 4/2000 Bowen et al. ..... 141/231
6,374,761 B1 * 4/2002 Dhellemmes ..... 114/74 A
6,378,722 B1 * 4/2002 Dhellemmes ..... 220/586
6,419,195 B1 * 7/2002 Van Reed et al. ..... 248/154
6,551,024 B1 * 4/2003 Berg et al. ..... 405/54
6,626,319 B2 * 9/2003 Miller et al. ..... 220/560.07
6,971,537 B2 * 12/2005 Enright, Jr. ..... 220/560.08
6,986,494 B2 * 1/2006 Strasser ..... 248/500
7,171,916 B2 * 2/2007 Yang et al. ..... 114/74 A
7,204,195 B2 * 4/2007 Yang et al. ..... 114/74 A
7,325,288 B2 * 2/2008 Yang et al. ..... 29/455.1
7,469,650 B2 * 12/2008 Jordan et al. ..... 114/74 A
2003/0066834 A1 * 4/2003 Enright, Jr. ..... 220/9.4
2005/0205573 A1 * 9/2005 Fleenor ..... 220/233
2006/0118018 A1 * 6/2006 Yang et al. ..... 114/74 A
2006/0131304 A1 * 6/2006 Yang et al. ..... 220/4.16
2007/0246473 A1 * 10/2007 Yang et al. ..... 220/565

FOREIGN PATENT DOCUMENTS

JP S56-020897 A 2/1981
JP H05-034398 U 5/1993
WO WO2006/062271 6/2006
WO WO 2008007837 A1 * 1/2008

* cited by examiner

PRIOR ART

ANCHOR FOR LIQUEFIED NATURAL GAS STORAGE TANK

BACKGROUND OF THE INVENTION

The present invention relates to liquefied natural gas (LNG) storage tanks built for marine vessels, and more particularly to the anchor and corner structures which are used to construct a heat insulating wall and sealing walls of an LNG storage tank built in a marine vessel for storage and transport of liquefied natural gas in a cryogenic state.

Liquefied natural gas (LNG) is formed through liquefaction of natural gas (i.e., a fossil fuel) and stored in LNG storage tanks. Depending on location, the LNG storage tanks are typically classified into on-land storage tanks built above or in the ground, and movable storage tanks installed on carriers such as vehicles, marine vessels, etc.

Since LNG is likely to explode if in a collision and is stored in a cryogenic state, the LNG storage tank must be firmly collision resistant and liquid-tight.

Compared with the on-land storage tank, which experiences little movement of the LNG, the LNG storage tank installed on vehicles or marine vessels experiences movement of the LNG, and is thus required to have a countermeasure capable of relieving mechanical stress caused by the movement of the LNG. In this regard, since the LNG storage tank installed in the marine vessel with the countermeasure against the mechanical stress can also be used as the on-land storage tank, the structure of the LNG storage tank installed in the marine vessel will hereinafter be described as an example.

FIG. 1 is a cross-sectional view schematically showing a marine vessel in which a conventional LNG storage tank is installed.

Referring to FIG. 1, the marine vessel 1 with the conventional LNG storage tank has a double walled hull, which comprises of an outer wall 16 and an inner wall 12 formed inside the outer wall 16. The inner and outer walls 12, 16 of the marine vessel 1 are connected to each other by connection ribs 13. In some cases, the marine vessel 1 can be made of a single walled hull.

The interior of the hull, that is, the interior of the inner wall 12, can be divided by one or more partitions 14. The partitions 14 can be formed by known cofferdams, which are installed in typical floating storage offloading vessels like the marine vessel 1 of FIG. 1.

Each of the inner spaces divided by the partitions 14 can be utilized as a storage tank 10 to store a cryogenic liquid such as LNG.

Here, an inner peripheral surface of the storage tank 10 is sealed liquid-tight by a sealing wall 50. In other words, the sealing wall 50 defines a single storage space with a plurality of metal plates welded together, so that the storage tank 10 can store and transport LNG without any leakage.

The sealing wall 50 in direct contact with LNG in the cryogenic state can be formed with corrugation to endure the temperature variation caused by the loading and unloading of LNG, as known in the art. The sealing wall 50 is connected to the inner wall 12 or the partition 14 of the vessel 1 by a plurality of anchor structures 30. Thus, the sealing wall 50 cannot be moved with respect to the hull.

A heat insulating wall is arranged between the sealing wall 50 and the inner wall 12 or the partition 14 to form a heat insulating layer therebetween. The heat insulating wall includes a corner structure 20 placed at a corner of the storage tank 10, an anchor structure 30 placed around an anchor member (not shown), and a planar structure 40 placed on a planar section of the storage tank 10. In this way, the overall heat insulating layer can be formed on the storage tank 10 by the corner structure 20, anchor structure 30, and planar structure 40.

Here, the anchor structure 30 comprises of a rod-shaped anchor member directly connected between the sealing wall and the hull to secure the sealing wall to the hull, and a heat-insulating material surrounding the anchor member.

The anchor structure 30 mainly serves to support the sealing wall 50, whereas the corner structure 20 and the planar structure 40 mainly serve to support the load the LNG exerts on the sealing wall 50. The corner structure 20 and the planar structure 40 are not directly connected to the anchor structure 30.

FIG. 2 is a cross-sectional view showing a part of a conventional LNG storage tank disclosed in Korean Patent No. 499710 issued to the applicant of this invention.

Referring to FIG. 2, the conventional LNG storage tank 10 includes a primary heat insulating wall 24, 34, 44 and a secondary heat insulating wall 22, 32, 42 sequentially stacked on the bottom of the hull, and a secondary sealing wall 23, 33, 43 between the primary heat insulating wall 24, 34, 44 and the secondary heat insulating wall 22, 32, 42 to seal the heat insulating walls. In addition, a primary sealing wall 50 is placed on the primary heat insulating wall 24, 34, 44.

The LNG storage tank 10 constructed as described above further includes a corner structure 20 placed at an inside corner, an anchor structure 30 spaced a predetermined distance from the bottom, and a planar structure 40 slidably interposed between corner structures 20 or anchor structures 30. The corner structure 20, the anchor structure 30, and the planar structure 40 are manufactured as unit modules that can be assembled onto the storage tank 10. Then, with these structures assembled onto the storage tank 10, the primary sealing wall 50 is finally placed on the assembled structures to provide a liquid-tight seal to the heat insulating walls, thereby defining a space to store the LNG.

As shown in FIG. 2, each of the corner structure 20, the anchor structure 30, and the planar structure 40 contains the primary heat insulating wall 24, 34, 44, the secondary heat insulating wall 22, 32, 42, and the secondary sealing wall 23, 33, 43, which will be commonly defined as heat insulating wall structures 20, 30, 40.

Meanwhile, in each unit module of the heat insulating wall structures 20, 30 and 40, the secondary sealing wall and each of the heat insulating walls are bonded together by adhesives. Typically, the secondary heat insulating wall 22, 32, 42 includes polyurethane foam, an insulating material, and a plate bonded to a lower surface of the polyurethane foam. The primary heat insulating wall 24, 34, 44 includes the polyurethane foam, and a plate bonded to the upper surface of the polyurethane foam by an adhesive. In addition, the primary sealing wall is positioned on the primary heat insulating wall 24, 34, 44, and welded to the anchor structure 30.

The secondary heat insulating wall 42 of the planar structure 40 is formed at a lower end with a flange 42*a* greater than the secondary heat insulating wall 42. The flange 42*a* is fitted into a groove formed in the lower end of the anchor structure 30 to slide somewhat therein.

In the construction shown in the drawing, the anchor structure 30 includes an anchor support rod 36, a securing member 37 positioned at a lower portion of the anchor structure 30, the primary anchor heat insulating wall 34, the secondary anchor heat insulating wall 32, and the secondary sealing wall 33 interposed between the primary anchor heat insulating wall 34 and the secondary anchor heat insulating wall 32. The anchor support rod 36 is connected at one end to the primary sealing wall 50, and at the other end to the inner wall 12 of the hull via the securing member 37.

The anchor support rod 36 of the anchor structure 30 has an upper end welded to the primary sealing wall 50.

Furthermore, the anchor structure 30 is positioned at a connection between the adjacent planar structures 40 to connect the planar structures 40, which are secured to the inner wall 12 or the partition 14 defines the storage tank 10. The securing member 37 of the anchor structure 30 is placed around the anchor support rod 36.

As such, since the heat insulating wall structures of the conventional LNG storage tank comprise the primary and secondary heat insulating walls, and the primary and secondary sealing walls, the conventional LNG storage tank is complicated in overall construction, in particular, in construction for connecting the secondary sealing wall, which makes it difficult to construct the heat insulting walls. Furthermore, the complexity in construction and installation of the anchor structure or the connecting structure for the secondary sealing walls deteriorates the reliability in the sealing properties of the secondary sealing wall, which can cause leakage of the LNG.

Furthermore, for the conventional anchor structure 30 which connects the inner surface of the hull and the primary sealing wall 50 via the anchor support rod 36, and the conventional corner structure 20 which supports only the load of the LNG exerted on the sealing wall 50 without supporting the sealing wall 50, it has been required to further improve the capability of absorbing stress occurred from the thermal deformation of the storage tank or deformation of the hull resulting from the loading and unloading of the LNG in the cryogenic state.

In order to achieve reduce the boiled off gas (BOG), which is a loss caused by vaporization of the LNG in the cryogenic state, and simplification in the construction and manufacturing process while solving the aforementioned problems, an LNG storage tank having a new construction completely different from that of the conventional LNG storage tank has been suggested. As a result, there is a needs for an improved anchor and corner structures corresponding to the new LNG storage tank.

SUMMARY OF THE INVENTION

The present invention provides an improved structure for a liquefied natural gas storage tank, which has a simple construction for the heat insulating wall and sealing walls, and a simple connecting structure between the heat insulating wall and the sealing walls, enabling convenient assembly thereof, which increases the reliability of the seal while simplifying the assembled structure and manufacturing process, thereby reducing the construction time of the storage tank, and which can efficiently reduce mechanical stress exerted on the storage tank by use of an anchor member and a corner member.

In accordance with one aspect of the present invention, there is provided a structure of a liquefied natural gas (LNG) storage tank comprising a heat insulating wall disposed on an inner surface of the LNG storage tank to form a heat insulating layer, sealing walls disposed on the heat insulating wall to directly contact LNG, and the structure to support the sealing walls, wherein the structure comprises an anchor structure including an anchor member connected between the sealing walls and the inner surface of the storage tank to secure the sealing walls to the inner surface of the storage tank, and a heat-insulating material formed around the anchor member, the anchor member being connected at a plurality of locations to the inner surface of the storage tank.

The structure of the LNG storage tank may further comprise a corner structure placed at a corner of the storage tank to support the sealing walls.

The corner structure may comprise a corner member connected between the sealing walls and the inner surface of the storage tank to secure the sealing walls to the inner surface thereof, and a heat-insulating material formed around the corner member, the corner member comprising a fixed member secured to the inner surface of the corner of the storage tank and a movable member supported on the fixed member to linearly move thereon.

DESCRIPTION OF SPECIFIC EMBODIMENTS

The embodiments will be described in detail with reference to the accompanying drawings.

First, there will be described an anchor member and an anchor structure placed in an LNG storage tank according to the present invention with reference to FIGS. 3 to 8.

Figure 1:
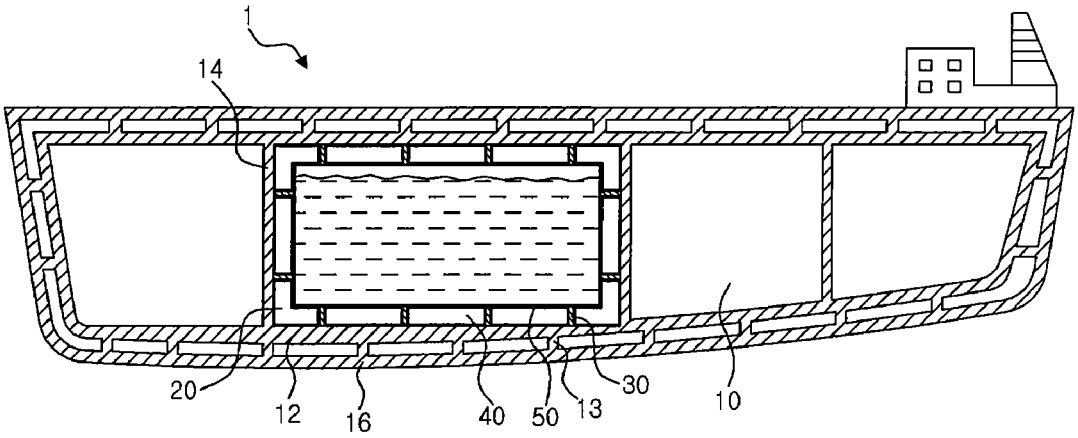
FIG. 1 is a cross-sectional view schematically showing a marine vessel in which a conventional LNG storage tank is built.
Figure 2:
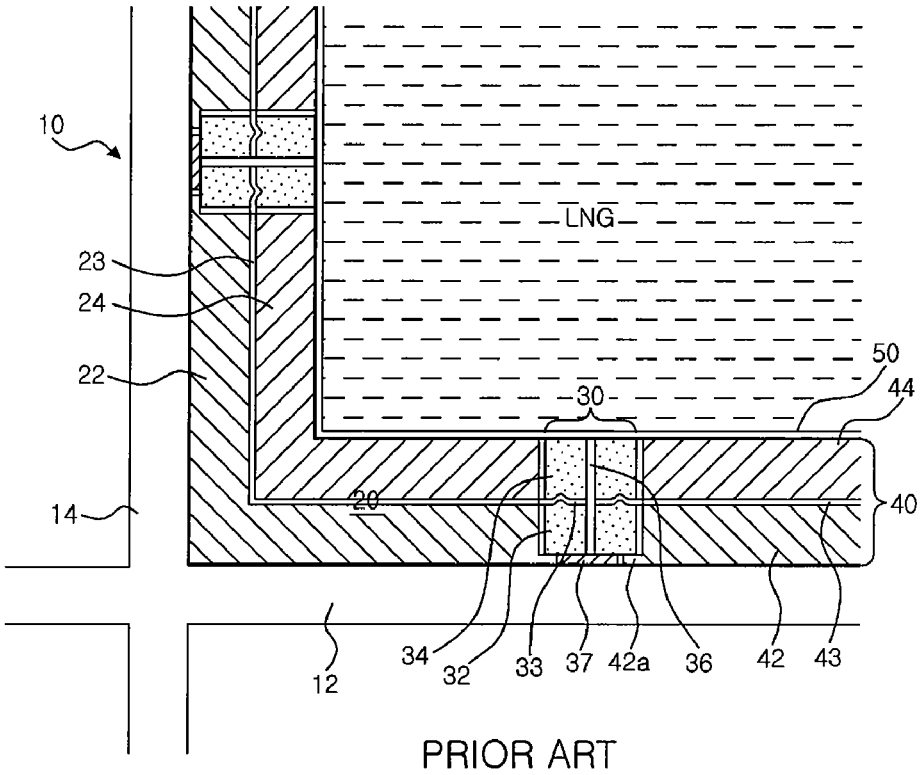
PRIOR ART Fig. 2
FIG. 2 is a cross-sectional view showing a part of the conventional LNG storage tank.
Figure 3:
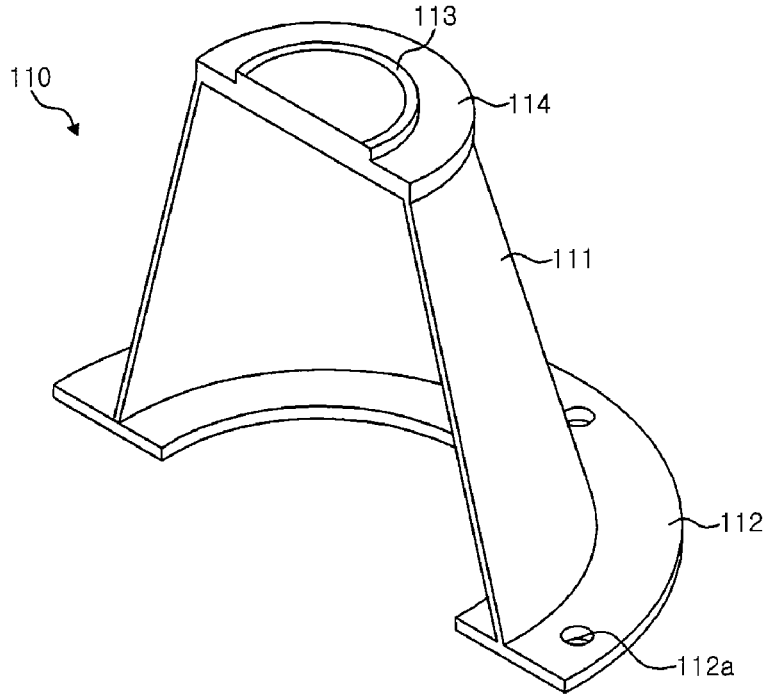
FIG. 3 is a perspective view of an anchor member placed in an LNG storage tank according to one embodiment of the present invention.
Figure 4:
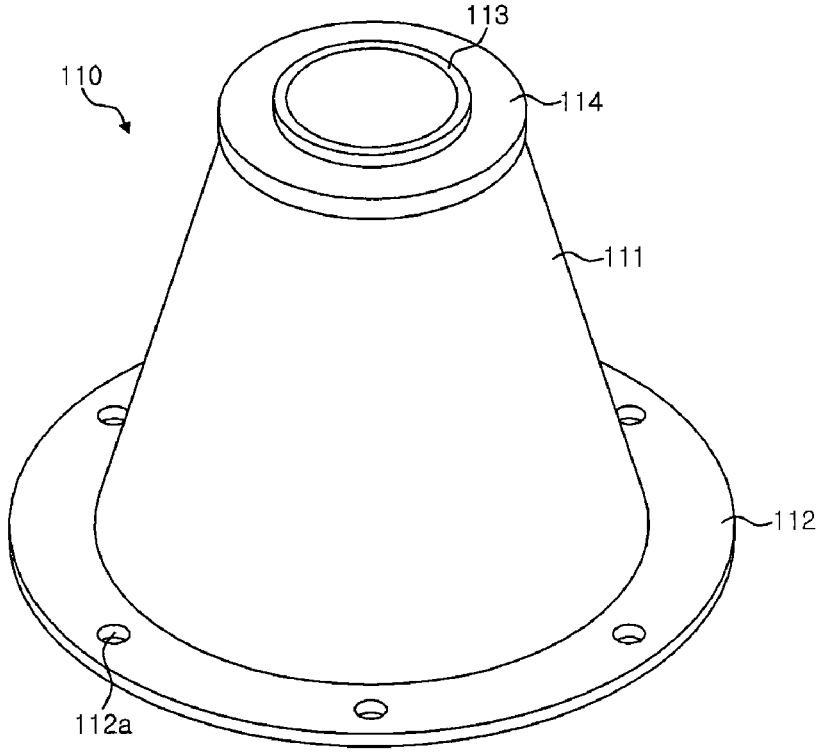
FIG. 4 is a partially cut-away perspective view of the anchor member shown in FIG. 3.
Figure 5:
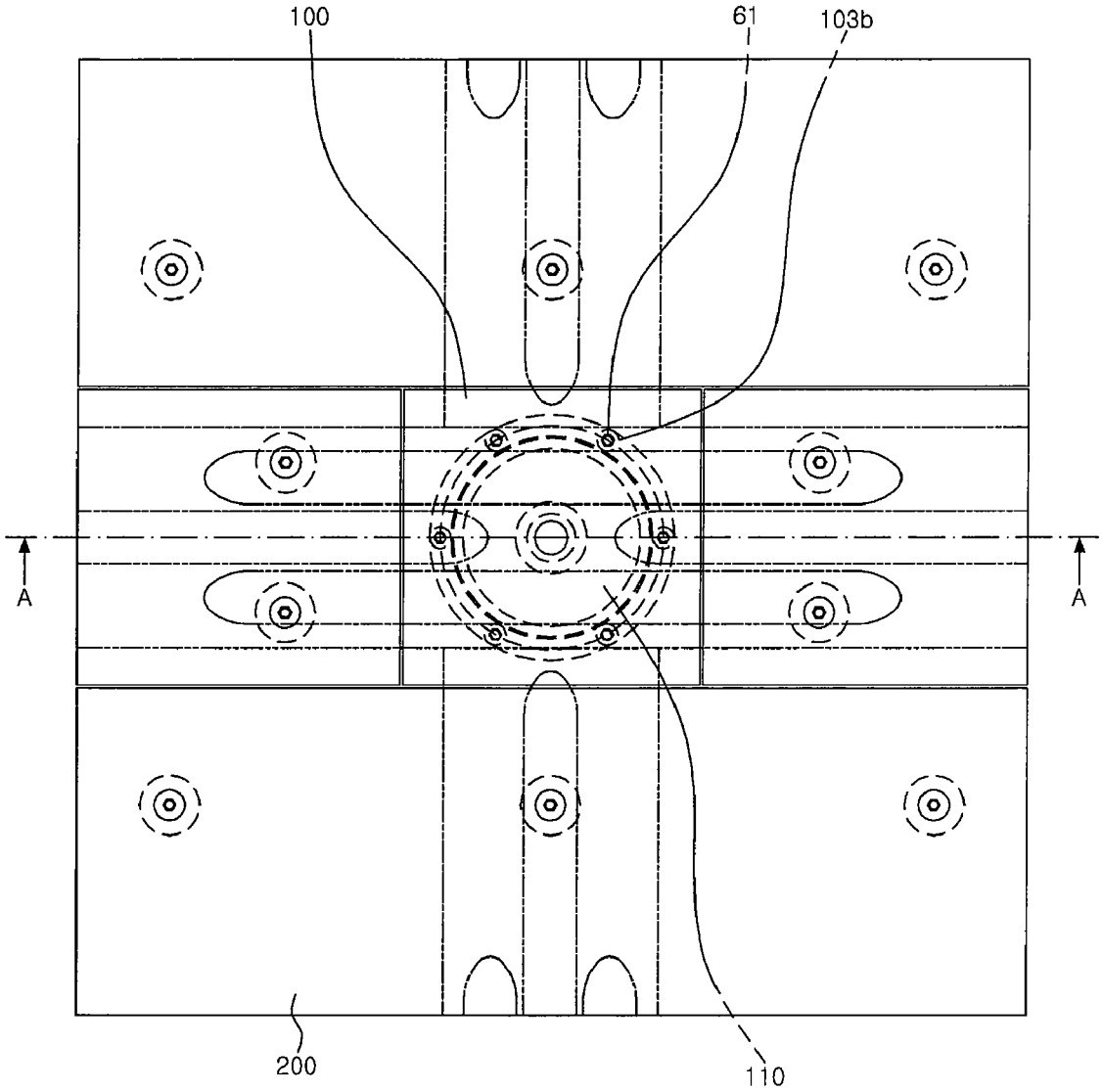
FIG. 5 is a plan view showing a part of the LNG storage tank in which an anchor structure comprising the anchor member shown in FIG. 3 is built.
Figure 6:
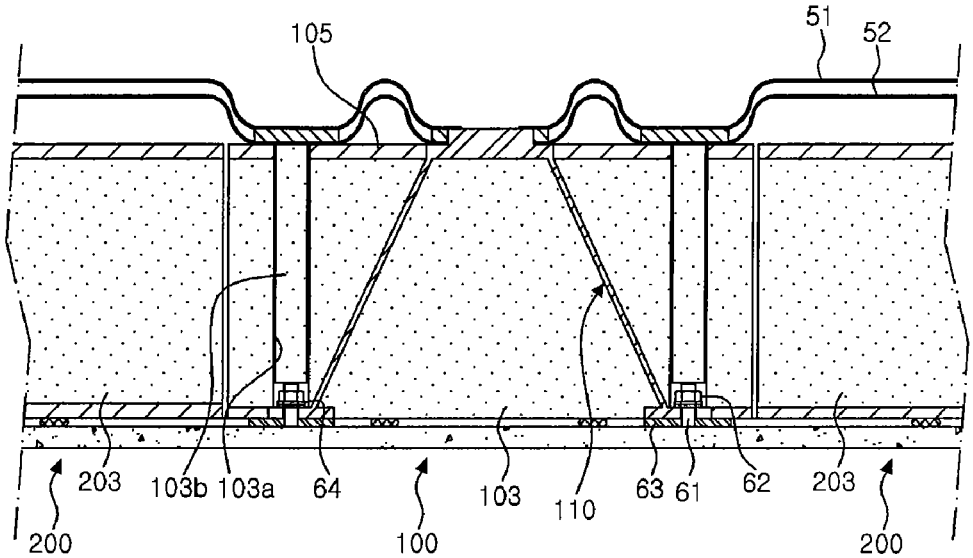
FIG. 6 is a partially cross-sectional view taken along line A-A of FIG. 5.

FIG. 3 is a perspective view and FIG. 4 is a partially cut-away perspective view of an anchor member placed in an LNG storage tank according to one embodiment of the present invention. FIG. 5 is a plan view and FIG. 6 is a cross-sectional view showing a part of the LNG storage tank in which an anchor structure comprising the anchor member is placed.

Referring to FIGS. 3 and 4, the anchor member 110 according to the embodiment has a frustoconical shape (i.e., a cone with a planar top surface). The frustoconical anchor member 110 is closed at the upper portion and opened at the lower portion.

The anchor member 110 has a frustoconical body 111 attached to a lower securing part 112. The anchor member 110 is secured to an inner surface of a storage tank 10, that is, an inner wall 12 or a partition 14, as will be described as follows with reference to FIGS. 5 and 6.

Although the securing part 112 is illustrated as having a ring shape formed along the lower outer circumference of the body 111 of the anchor member 110, it should be noted that the securing part 112 may be partially formed along the lower outer circumference so as to have a continuous arc-shape or a plurality of non-continuous arc-shape.

In this embodiment, the ring-shaped securing part 112 is produced as a separate member, and then welded to the lower end of the body 111 of the anchor member 110.

In addition, the securing part 112 has a plurality of through-holes 112*a* formed at constant intervals such that a plurality of stud bolts 61 can be inserted into the through-holes 112*a* and fastened by nuts 62.

The anchor member 110 has a step on the top surface of the frusto-conical body 111 so that the two junction parts (i.e., first junction part 113 and second junction part 114) are formed to have a predetermined height difference therebetween. First and second sealing walls 51, 52 are welded to the first and second junction parts 113, 114, as will be described below with reference to FIG. 6.

In this embodiment, the first and second junction parts 113, 114 are produced separately and then welded to the upper end of the body 111 of the anchor member 110, thereby closing the upper end of the body 111 of the anchor member 110.

Referring to FIGS. 5 and 6, the storage tank 10 has an inner peripheral wall composed of the first and second sealing walls 51, 52, which provide a liquid-tight seal. The first and second sealing walls 51, 52 define a single storage space with a plurality of metal plates welded together, so that the storage tank 10 can store and transport the LNG without any leakage.

The first sealing wall 51 directly contacting the LNG in the cryogenic state, and the second sealing wall 52 spaced from the first sealing wall 51 may have corrugation to endure temperature variations resulting from the loading and unloading of the LNG.

The first and second sealing walls 51, 52 are connected to the inner wall 12 or the partition 14 of the marine vessel 1 via a plurality of anchor structures 100. Thus, the first and second sealing walls 51, 52 cannot be moved with respect to the hull.

A heat insulating wall is arranged between the second sealing wall 52 and the inner wall 12 or the partition 14 to form a heat insulating layer therebetween. The heat insulating wall is made up of a corner structure (not shown) placed at a corner of the storage tank 10, the anchor structure 100 including the anchor member 110, and a planar structure 200 placed on a planar section of the storage tank 10. In other words, the overall heat insulating layer of the storage tank 10 may be formed by the corner structure, anchor structure 100, and planar structure 200.

The anchor structure 110 supports the first and second sealing walls 51, 52, whereas the planar structure 200 supports only the load of the LNG exerted on the first and second sealing walls 51, 52, and works independently of the anchor structure 110.

Here, the anchor structure 100 includes the anchor member 110 directly connected between the first and second sealing walls 51, 52 and the hull to secure the first and second sealing walls 51, 52 to the hull, and a heat-insulating material 103 formed of polyurethane foam or reinforced polyurethane foam to surround the anchor member 110.

Plywood 105 may be attached to one or both of the upper and lower ends of the heat-insulating material 130. Although the plywood is illustrated as being attached to the upper end of the anchor structure 100 and the upper and lower ends of the planar structure 200 in FIG. 6, it should be noted that the present invention is not limited to this structure.

The anchor heat-insulating material 103 in the anchor structure 10 has a density of about 35~45 kg/m$^3$, which is lower than the density of the planar heat-insulating material 203 of the planar structure 200 (about 115~125 kg/m$^3$). In this regard, although the density of the anchor heat-insulating material 103 is lower than that of the planar heat-insulating material 203, the anchor structure 100 can maintain a sufficient strength due to the anchor member 110 embedded therein.

The anchor structure 100 constructed as above is secured to the inner surface of the storage tank 10 via the securing part 112 formed at the lower portion of the frustoconical body 111 of the anchor member 110.

As described above, the securing part 112 is formed with the plurality of through-holes 112*a* arranged at constant intervals, and the plurality of stud bolts 61 are inserted through the holes 112*a* and fastened by the nuts 62.

For this purpose, the anchor heat-insulating material 103 has a lower surface that is substantially coplanar with a lower surface of the securing part 112, and is formed with a plurality of cylindrical hollows 103*a* (i.e., holes in the heat-insulating material) extending in a vertical direction and aligned with the through-holes 112*a* of the securing part 112.

The cylindrical hollows 103*a* may be formed by use of a mold when forming the heat-insulating material at an initial stage, or in such a way that the heat-insulating material is formed in a hexahedral shape around the anchor member 110 and then cut away at portions where the cylindrical hollows 103*a* are formed.

After positioning the anchor structure 100 such that the stud bolts 61 can be inserted through the through-holes 112*a*, the nuts 62 are inserted through the cylindrical hollows 103*a*, and fastened to the stud bolts 61, securing the anchor structure 100 to the inner surface of the storage tank 10.

At this time, a leveling plate 63 may be interposed between the lower surface of the securing part 112 of the anchor member 110 and the inner surface of the storage tank 10 to level off the heat insulating wall, if necessary, as well known in the art. Furthermore, a washer 64 may be interposed between the upper surface of the securing part 112 of the anchor member 110 and the nuts 62 fastened to the stud bolts 61, as well known in the art.

After securing the anchor structure 100 to the inner surface of the storage tank 10 by fastening the nuts 62 inserted through the cylindrical hollows 103*a* to the stud bolts 61, a cylindrical heat-insulating material 103*b* having a shape corresponding to that of the cylindrical hollows 103*a* is inserted into each of the cylindrical hollows 103*a*.

In addition, as described above, the first junction part 113 and the second junction part 114 are formed to have a predetermined height difference on the top surface of the frusto-conical body 111 of the anchor member 110. The first and second sealing walls 51, 52 are welded to the first and second junction parts 113, 114, respectively.

Meanwhile, although the sealing structure is illustrated as having the double structure of the first sealing wall 51 and the second sealing wall 52 in FIG. 6, the sealing structure may be embodied with a multilayer structure of three or more layers.

As such, according to one embodiment of the present invention, the plurality of stud bolts 61 secured to the inner surface of the storage tank are inserted into the plurality of through-holes 112*a* formed along the ring-shaped securing part 112 of the anchor member, and then fastened by the nuts 62, so that the anchor member 110 and the sealing walls 51, 52 can be secured to the hull.

In this way, attaching the anchor member 110 to the inner surface of the storage tank can be accomplished by a simple operation of nut fastening.

Furthermore, since the anchor member 110 and the inner surface of the storage tank are attached to each other at a plurality of consecutive locations, it is possible to absorb stress resulting from thermal deformation caused by loading and unloading of the LNG or from deformation of the hull caused by an external force such as waves.

Figure 7:
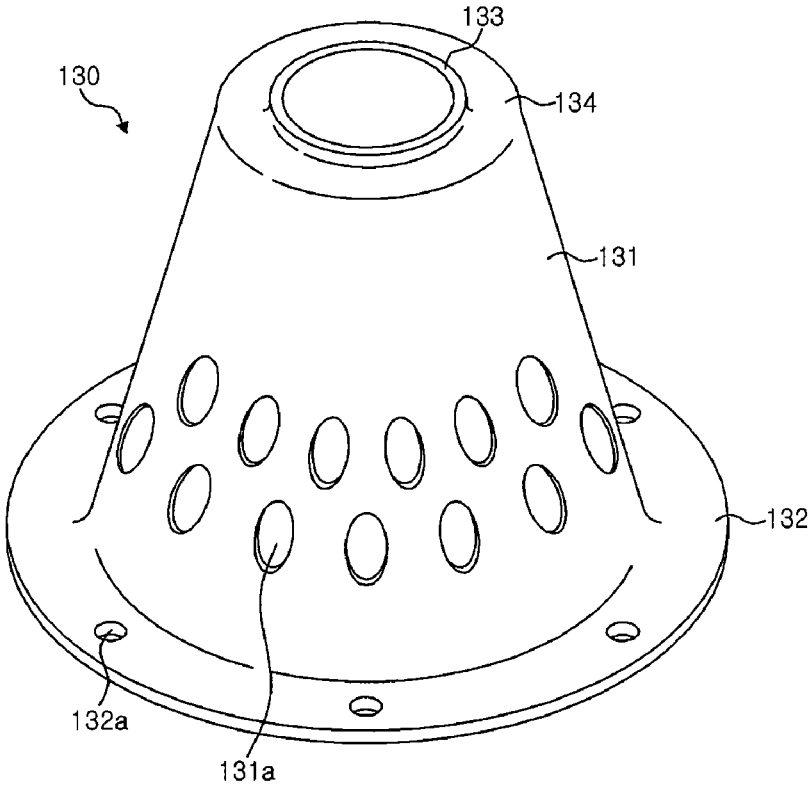
FIG. 7 is a perspective view of an anchor member in the LNG storage tank according to an alternative embodiment of the present invention.
Figure 8:
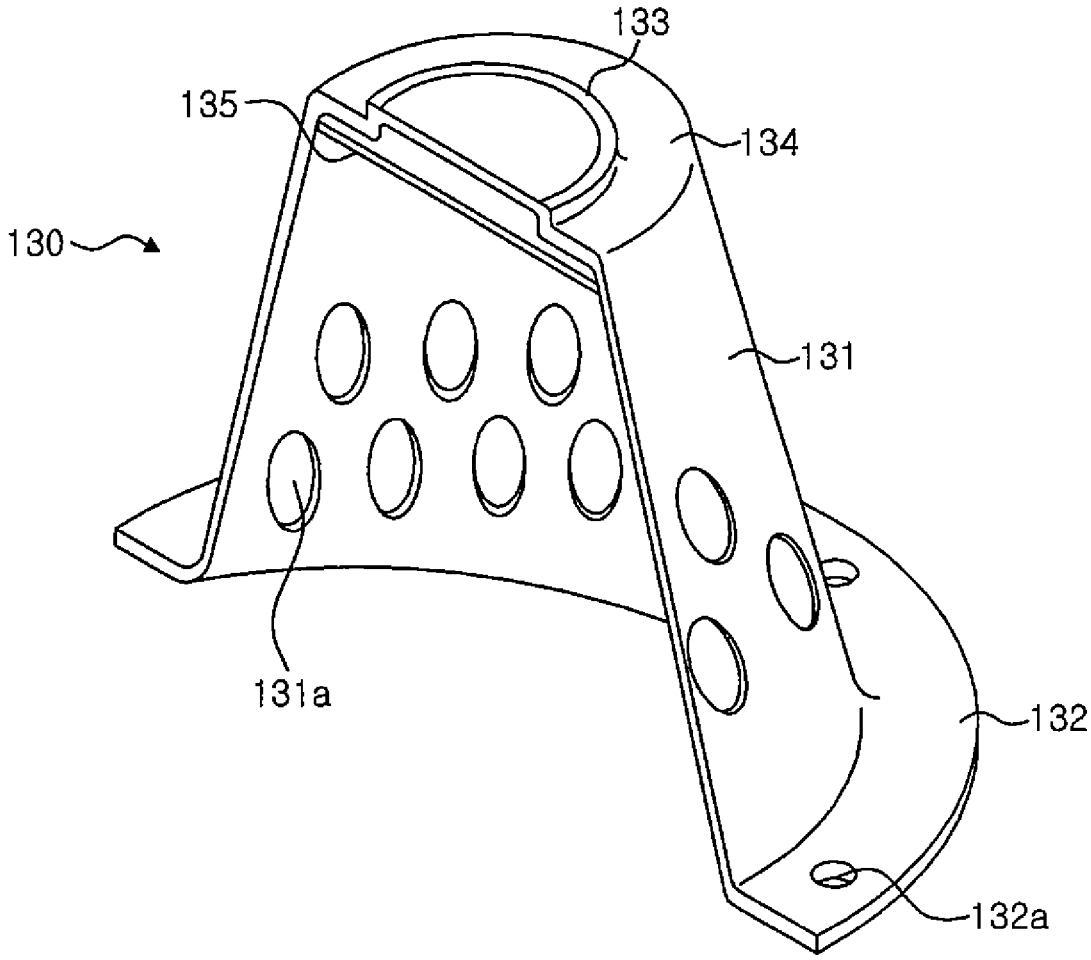
FIG. 8 is a partially cut-away perspective view of the anchor member shown in FIG. 7.

FIGS. 7 and 8 are a perspective view and a partially cutaway perspective view of an anchor member according to an alternative embodiment of the present invention. In the embodiment described above, the anchor member 110 is constructed by attaching the separately produced securing part 112, first junction part 113, and second junction parts 114 to the lower and upper ends of the frustoconical body 111. Compared with such an anchor member 110, an anchor member 130 according to this embodiment comprises a body with which a securing part and junction parts are integrally formed, and which has a plurality of through-holes formed therein. Hereinafter, the description of the anchor member 130 of the alternative embodiment will be described by explaining some of the features that are different from the anchor member 110.

As in the above embodiment, the anchor member 130 of the alternative embodiment has a frustoconical body having a planar top surface, which is closed at the upper surface and opened at a lower surface, as shown in FIGS. 7 and 8.

As in the above embodiment, the anchor member 130 comprises a frustoconical body 131, which is integrally formed at a lower portion with a securing part 132 through which the anchor member 130 is secured to the inner surface of the storage tank 10.

The securing part 132 has a plurality of through-holes 132*a* formed at certain intervals such that a plurality of stud bolts 61 can be inserted into the through-holes 112*a* and fastened by nuts 62. The intervals may be the same or different.

As in the above embodiment, the frustoconical body 131 of the anchor member 130 is integrally formed at the top surface with first and second junction parts 113, 114, which have a predetermined height difference, and are respectively welded to the first and second sealing walls 51, 52.

The reinforcing plate 135 may be mounted inside an upper end of the anchor member 130 by welding, as shown in FIG. 8, to provide a double structure to the upper portion of the anchor member 130 where the first and second junction parts 133, 134 are formed.

The plurality of through-holes 131*a* is arranged in a zigzag pattern in the body 131 of the anchor member 130 according to this embodiment. Additionally, by forming the through-holes 131*a* to have an elliptical shape as well as being arranged in the zigzag pattern on the body 131, there is an effect of extending a transfer path of cold energy from an upper end to a lower end of the anchor member 130, which can prevent loss of the cold energy.

According to the alternative embodiment, the forming of the heat-insulating material to surround the anchor member 130, the forming of the anchor structure with the anchor member 130 and the heat-insulating material, the securing of the anchor structure comprising the anchor member 130 to the hull and the first and second sealing walls 51, 52 are the same as those of the above embodiment, and thus are omitted hereinafter.

In this way, the alternative embodiment not only has the advantages of the above embodiment, but also other advantages as follows. That is, according to the alternative embodiment, since the anchor member can be formed as a single component by pressing, a process of producing the anchor member can become more simple, and since the elliptical through-holes are arranged in the zigzag pattern on the body of the anchor member to increase the transfer path of the cold energy, it is possible to further reduce the loss of the cold energy.

Referring to FIGS. 9 to 12, a corner member and the corner structure for the LNG storage tank according to one embodiment of the present invention will be described hereinafter.

Figure 9:
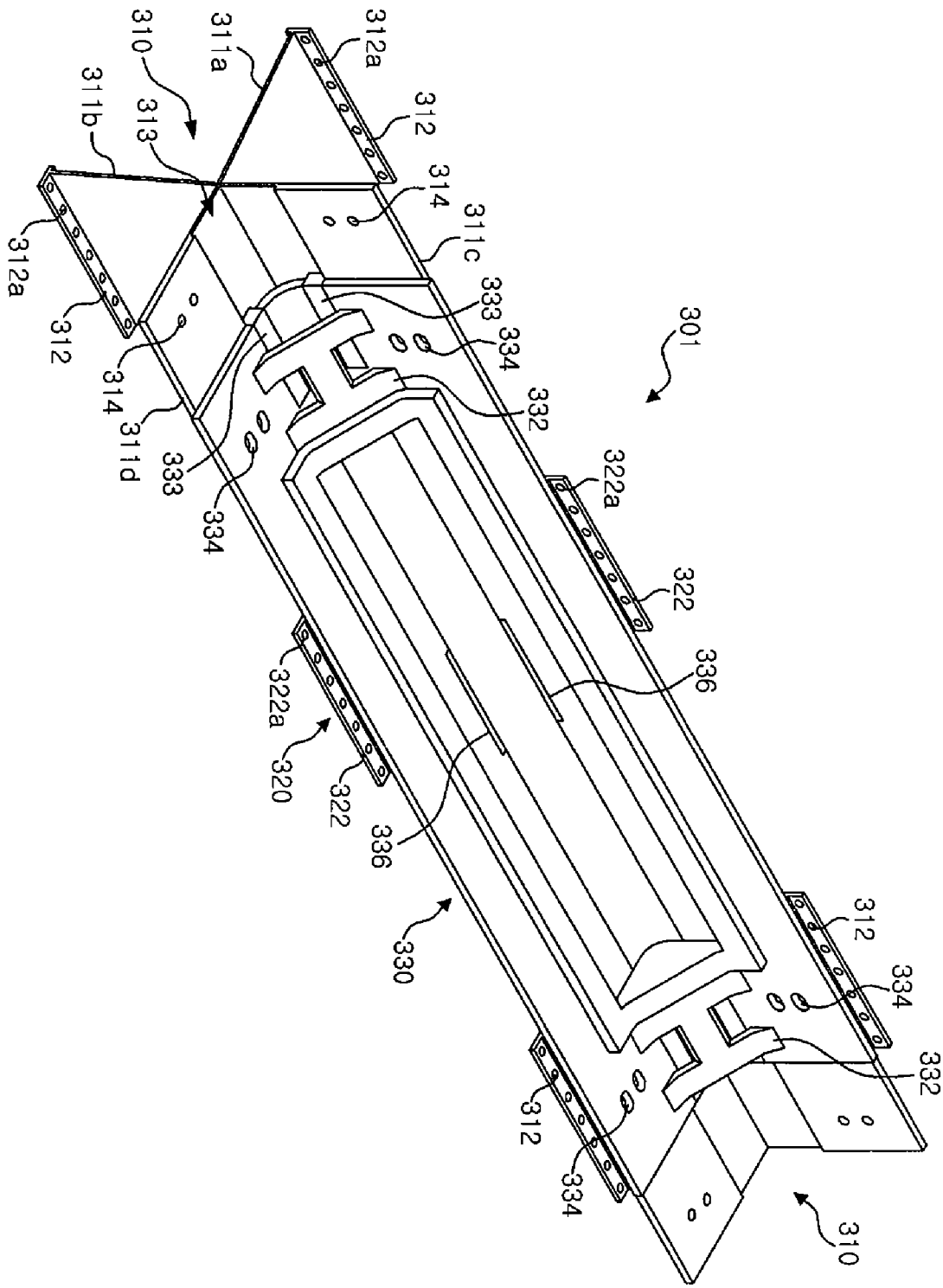
FIG. 9 is a perspective view of a corner member in the LNG storage tank according to one embodiment of the present invention.
Figure 10:
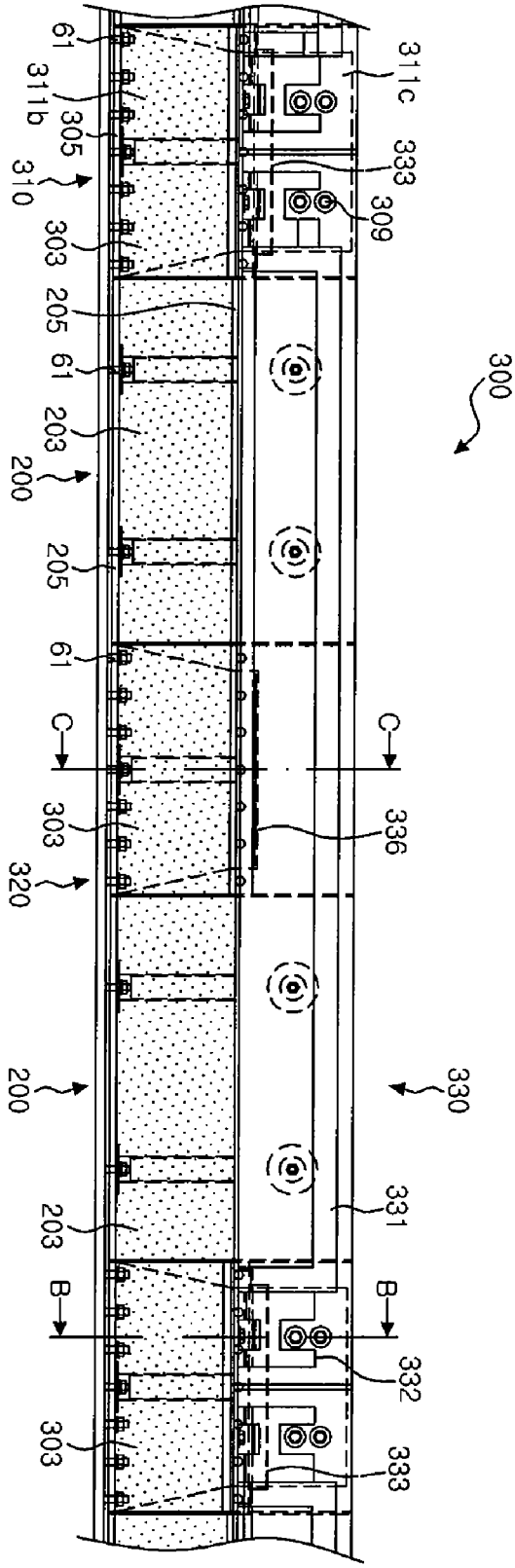
FIG. 10 is a longitudinal cross-sectional view illustrating a part of the LNG storage tank in which a corner structure comprising the corner member of FIG. 9 is placed.
Figure 11:
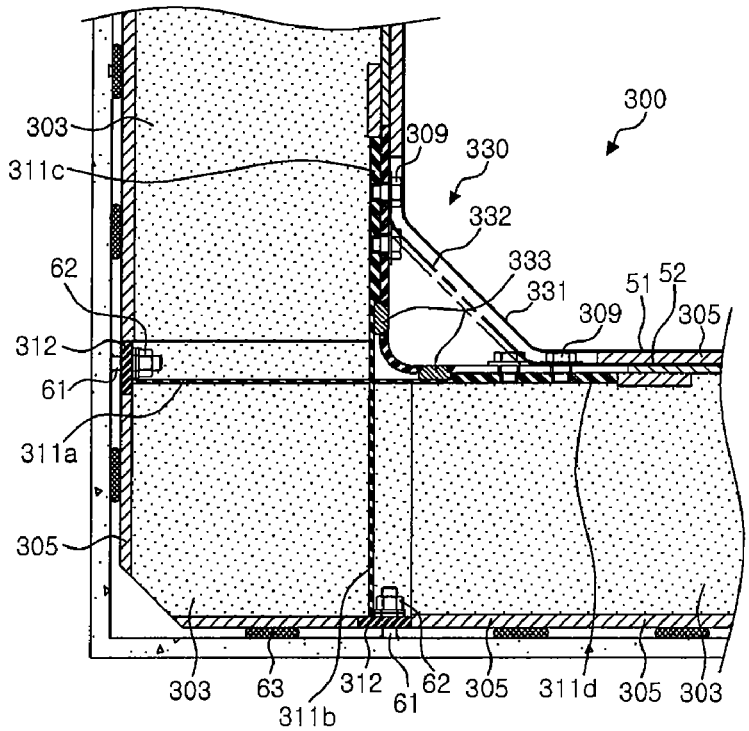
FIG. 11 is a transverse cross-sectional view of the corner structure taken along line B-B of FIG. 10.
Figure 12:
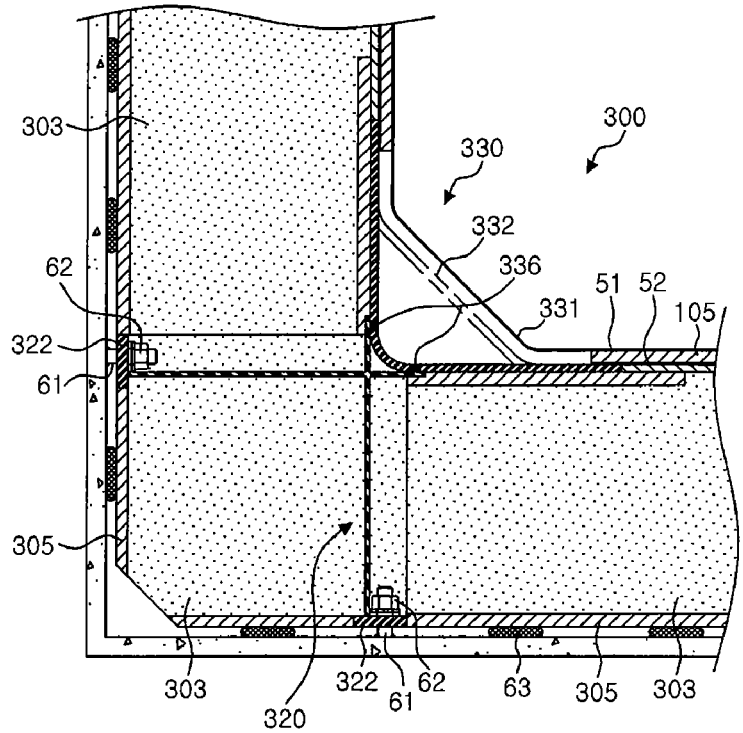
FIG. 12 is a transverse cross-sectional view of the corner structure taken along line C-C of FIG. 10.

FIG. 9 is a perspective view of a corner member according to one embodiment of the present invention, and FIG. 10 is a longitudinal cross-sectional view showing a part of the LNG storage tank in which the corner structure comprising the corner member shown in FIG. 9 is built. FIGS. 11 and 12 are transverse cross-sectional views of the corner structure taken along line B-B and line C-C shown in FIG. 10, respectively.

In FIGS. 9 to 12, the corner member 301 of this embodiment includes a fixed member 310 secured to the inner surface of the storage tank 10 (i.e., the surface of the inner wall 12 or the partition 14) and a movable member 330 supported on the fixed member 310 while being joined to the sealing walls 51, 52.

The movable member 330 is installed to allow a very minute movement in a linear direction with respect to the fixed member (will be described in more detail below) when thermal deformation occurs caused by temperature variation resulting from loading and unloading of the LNG in the cryogenic state or deformation of the hull by waves.

As viewed from the front side, the fixed member 310 has a cross shape (+) wherein four extensions, that is, first to fourth extensions 311*a* to 311*d*, cross each other at right angles. Among these first to fourth extensions 311*a* to 311*d*, adjacent two extensions, that is, the first and second extensions 311*a*, 311*b*, are secured to the inner surface of the storage tank 10, and the remaining two extensions, that is, the third and fourth extensions 311*c*, 311*d*, support the movable member 330.

The first to fourth four extensions 311*a* to 311*d* may be formed separately, and then welded to each other. Alternatively, the two extensions, that is, the first and second extensions 311*a*, 311*b* or the second and fourth extensions 311*c*, 311*d*, may be formed as an integrated component, and then joined to another component of the other two extensions by welding or the like.

To enlarge the contact area with respect to the inner surface of the storage tank 10, the first and second two extensions 311*a*, 311*b* have a trapezoidal shape (see FIG. 10) of which the width increases toward the storage tank 10, as viewed from the lateral side.

Each of the first and second extensions 311*a*, 311*b* is formed at a distal end with a securing part 312, as will be described below with reference to FIGS. 10 to 12, which serves to secure the corner member 301 to the inner surface of the storage tank 10 (i.e., the surface of the inner wall 12 or the partition 14).

The securing parts 312 may be integrally formed with the first and second extensions 311*a*, 311*b*, or may be individually formed and joined thereto by welding and the like.

The securing part 312 has a plurality of through-holes 312*a* formed at constant intervals such that a plurality of stud bolts 61 secured to the inner surface of the storage tank 10 can be inserted into the through-holes 312*a* and fastened by nuts 62.

In FIGS. 10 and 11, each of the third and fourth extensions 311*c*, 311*d* is formed with a through-hole 314 into which a bolt 309 is inserted and fastened to the movable member 330, and with a guide recess 313 which guides the movable member 330 and allows minute movement in a linear direction while being supported on the fixed member.

The movable member 330 has a substantially L-shape to be placed along the corner of the storage tank 10.

The movable member 330 is formed with two junction parts (i.e., first and second junction parts 331, 332) with a predetermined height difference therebetween. The first and second sealing walls 51, 52 are welded to the first and second junction parts 331, 332.

Each part of the movable member 330 facing the fixed member 310 is formed with a through-hole 334 through which a bolt 309 is inserted and fastened to the fixed member 310, and with a guide protrusion 333 to guide the movable member 330 to allow minute movement in the linear direction along the guide recess 313 of the fixed member 310, as shown in FIGS. 10 and 11.

The two guide protrusions 333 may be made independent of the movable member 330, and welded to locations of the movable member 330 corresponding to the guide recesses 313 of the fixed member 310, as shown in FIG. 11, after positioning the movable member 330 on the fixed member 310. The reason is that, if the two guide protrusions 333 are integrally formed with the movable member 330, the guide protrusions 333 of the movable member 330 cannot be inserted into the guide recesses 313 of the fixed member 310 due to interference with the guide recesses 313 when positioning the movable member 330 on the fixed member 310, failing to couple the fixed member 310 to the movable member 330.

The movable member 330 of this embodiment is positioned and supported on two fixed members spaced a predetermined distance from each other along the corner of the storage tank 10.

As shown in FIGS. 10 to 12, each of the fixed members 310 can be secured to the inner surface of the storage tank 10 by inserting the plurality of stud bolts 61 secured to the inner surface of the storage tank 10 into the through-holes 312*a* formed in the securing part 312 of the fixed member 310, and then fastening the nuts 62 to the stud bolts 61.

In addition, the movable member 330 is coupled at opposite sides to the fixed members 310 by fastening the bolts 309 inserted through the through-holes 334 formed at opposite sides of the movable member 330 and through the through-holes 314 formed in the third and fourth extensions 311*c*, 311*d* of the fixed members 310 after positioning the opposite sides of the movable member 330 on the fixed members 310 secured to the inner surface of the storage tank 10, as described above.

Here, the movable member 330 and the fixed members 310 are coupled so as not to avoid a relative movement therebetween. Rather, the movable member 330 is coupled to the fixed members 310 such that the movable member 330 can be linearly moved by the guide recesses 313 of the fixed members 310 and the guide protrusions 333 of the movable member 330, as described above, when the movable member 330 is stretched or compressed in the longitudinal direction.

For this purpose, the through-holes at one side among the through-holes 334 formed at the opposite sides of the movable member 330 and the through-holes 314 formed in the third and fourth extensions 311*c*, 311*d* of the fixed member 310 are preferably formed in an elongated shape.

Preferably, the corner member 301 may further include a connection member 320, which is placed in the middle between the fixed members 310 (i.e., in the middle of the movable member 330) and has a shape similar to that of the fixed member 310.

As in the first and second extensions 311*a*, 311*b* of the fixed member, the connection member 320 may also have a trapezoidal shape (see FIG. 10) of which the width increases toward the storage tank 10, as viewed from the lateral side, in order to enlarge the contact area with the inner surface of the storage tank 10.

At one end of the connection member 320, the connection member 320 is integrally provided with securing parts 322 in which through-holes 322*a* are formed. Thus, as in the fixed member 310, the connection member 320 is secured to the inner surface of the storage tank 10 by inserting a plurality of stud bolts 61 secured to the inner surface of the storage tank 10 into the through-holes 322*a* of the connection member 320, and then fastening the nuts 62 to the stud bolts 61.

Meanwhile, the other end of the connection member 320 may be welded to the movable member 330. The movable member 330 is formed at corresponding locations with welding slots 336 for joining the connection member 320 to the movable member 330 via welding. Thus, even when the movable member 330 is laid on the connection member 320 and the fixed members 310 after mounting the connection member 320 and the fixed members 310 on the inner surface of the storage tank 10, it is possible to join the movable member 330 and the connection member 320 via the welding slots 336.

As such, the movable member 330 is secured to the inner surface of the storage tank 10 via the connection member 320 at the middle of the movable member 330 in the longitudinal direction, while being attached at the opposite ends to the fixed members 310 so as to allow minute movement in the linear direction with respect to the fixed member 310.

The inner peripheral surface of the storage tank 10 is sealed liquid-tight by the first and second sealing walls 51, 52. In other words, the first and second sealing walls 51, 52 define a single storage space with a plurality of metal plates joined together by welding, so that the storage tank 10 can store and transport the LNG without any leakage.

The first sealing wall 51 in direct contact with the LNGin the cryogenic state, and the second sealing wall 52 spaced from the first sealing wall 51 may have corrugation to endure the temperature variation caused by the loading and unloading of the LNG, as known in the art.

The first and second sealing walls 51, 52 are fixedly connected to the inner wall 12 or the partition 14 of the marine vessel 1 by a plurality of the corner structures 300 and anchor structures. Thus, the first and second sealing walls 51 and 52 cannot be moved with respect to the hull.

A heat insulating wall may be placed between the second sealing wall 52 and the inner wall 12 or the partition 14 to form a heat insulating layer therebetween. The heat insulating wall comprises the corner structure 300 placed at the corner of the storage tank 10, the anchor structure 100 including an anchor member, and the planar structures 200 placed on a planar portion of the storage tank 10. As such, the overall heat insulating layer can be formed by the corner structure 300, anchor structure 100, and planar structure 200.

The corner structure 300 and the anchor structure 100 serve to support the first and the second sealing walls 51, 52, whereas the planar structure 200 serves to support the load of the LNG exerted on the sealing walls 51, 52 without being directly coupled to the anchor structure 100 (see FIG. 10).

Here, the corner structure 300 comprises the corner member 301 directly connected between the first and second sealing walls 51, 52 and the hull to secure the first and second sealing walls 51, 52 to the hull, and a heat-insulating material 303 integrally formed of polyurethane foam or reinforced polyurethane foam to surround the corner member 310.

Plywood 305 may be attached to one or both of the upper and lower ends of the heat-insulating material 303. Although the plywood is illustrated as being attached to the upper end of the corner structure 300 and the upper and lower ends of the planar structure 200 in FIGS. 4 to 6, the present invention is not limited to this structure.

The corner structure 300 of this embodiment is secured to the inner surface of the storage tank 10 via the securing parts 312, 322 of the fixed member 310 and the connection member 320 of the corner member 301.

As described above, the securing parts 312, 322 are formed with the plurality of through-holes 312*a*, 322*a* at constant intervals, through which the stud bolts 61 previously secured to the inner surface of the storage tank 10 are inserted and fastened by the nuts 62.

In addition, the leveling plate 63 may be interposed between the plywood 305 and 205 attached to the lower surfaces of the heat-insulating materials 303 and 203 and the inner surface of the storage tank 10 to level off, if necessary, as well known in the art. Furthermore, washers may be interposed between upper surfaces of the securing parts 312, 322 and the nuts 62 fastened to the stud bolts 61, as well known in the art.

In addition, as described above, the first junction part 331 and the second junction part 332 are stepped to have the predetermined height difference therebetween on the top surface of the movable member 330 of the corner member. The first and second sealing walls 51, 52 are welded to the first and second junction parts 331, 332, respectively.

Although the sealing structure is illustrated as having the double structure of the first sealing wall 51 and the second sealing wall 52 herein, the sealing structure may be embodied by a multilayer structure of three or more layers.

As such, according to this invention, the plurality of stud bolts 61 are inserted into the plurality of through-holes 312*a*, 322*a* formed in the securing parts 312, 322 of the fixed member 310 and the connection member 320, and then fastened by the nuts 62, so that the fixed member 310 and the connection member 320 can be secured to the hull.

In addition, the movable member 330 joined to the sealing walls 51, 52 is able to be minutely moved in the linear direction with respect to the fixed members by the guide recesses 313 and the guide protrusions 333, and is welded to the connection member 320 via the welding slots 335, so that the sealing walls 51, 52 can be secured to the hull.

According to the present invention, since the fixed members 310 and the connection member 320 making up the corner member 301 are attached to the inner surface of the storage tank at a plurality of consecutive locations, and the movable member 330 can be linearly moved with respect to the fixed members 310, it is possible to absorb the stress resulting from the thermal deformation caused by the loading and unloading of the LNG or from the deformation of the hull caused by an external force such as waves.

In the above embodiments of the anchor member and the corner member, the fixed member and the connection member are described as being secured to the inner surface of the hull by bolts and nuts. However, it should be noted that the present invention is not limited to this structure, and that the securing parts of the fixed member and the connection member can be directly welded to the inner surface of the hull.

Furthermore, the anchor member may have other polygonal cone shapes, such as a triangular pyramid, a quadrangular pyramid, etc., as well as the frustoconical shape.

Although the sealing walls are formed from corrugated stainless steel used for, for example, GTT Mark-III type, according to the embodiments, the sealing walls may be formed from Inva steel used for GTT NO 96.

Furthermore, the present invention can be applicable to an LNG storage tank on land as well as in the hull of a marine vessel.

As apparent from the above description, the anchor structure and the corner structure of the LNG storage tank according to the present invention can provide a simple construction of the heat insulating wall and the sealing walls, and a simple connecting structure therebetween, enabling convenient assembly. In addition, the anchor structure and the corner structure of the invention increase the reliability of sealing while simplifying the assembled structure and manufacturing process of the storage tank, reducing the construction time of the storage tank. Furthermore, the anchor structure and the corner structure of the invention relieve mechanical stress exerted on the storage tank.

It should be understood that the embodiments and the accompanying drawings have been described for illustrative purposes, and the present invention is limited only by the following claims. Further, those skilled in the art will appreciate that various modifications, additions and substitutions are allowed without departing from the scope and spirit of the invention as disclosed in the accompanying claims.

What is claimed is:

1. A liquefied natural gas (LNG) storage tank, comprising:

a heat insulating wall disposed on an inner surface of the LNG storage tank to form a heat insulating layer;

sealing walls disposed on the heat insulating wall to contact LNG; and a structure to support the sealing walls, wherein the structure comprises an anchor structure including:

an anchor member connected between the sealing walls and the inner surface of the storage tank to secure the sealing walls to the inner surface of the storage tank, and a heat-insulating material formed around the anchor member, the anchor member being coupled at a plurality of locations to the inner surface of the storage tank, wherein the sealing walls comprises a first sealing wall directly contacting the LNG and a second sealing wall spaced from the first sealing wall, wherein the anchor member comprises a frustoconical body having a closed top and an opened base, the opened base comprising a securing part connected to the inner surface of the storage tank, and the closed top comprising a first junction part and a second junction part wherein the first junction part is raised from the second junction part to have a predetermined height difference therebetween, and wherein the first sealing wall is welded to the first junction part and the second sealing wall is welded to the second junction part.

2. The LNG storage tank according to claim 1, wherein the securing part has a ring shape formed along an overall outer circumference at a lower end of the body of the anchor member, and is formed with a plurality of through-holes.

3. The LNG storage tank according to claim 1, wherein the frustoconical body of the anchor member comprises a plurality of holes arranged in a zigzag pattern.

4. The LNG storage tank according to claim 1, wherein the heat-insulating material of the anchor structure has a lower density than that of a planar heat-insulating material for a planar structure formed around the anchor structure.

5. The LNG storage tank according to claim 1, wherein the securing part is integrally formed with the opened base of the anchor member, and the first and second junction parts are integrally formed with the closed top of the anchor member.

6. The LNG storage tank according to claim 5, wherein the anchor member further comprises a reinforcing plate mounted inside an upper end of the anchor member to provide a double structure to the closed top of the anchor member where the first and second junction parts are formed.

7. The LNG storage tank according to claim 1, wherein the structure constituting the LNG storage tank further comprises a corner structure disposed at a corner of the storage tank to support the sealing walls, and wherein the corner structure comprises a corner member connected between the sealing walls and the inner surface of the storage tank to secure the sealing wall to the inner surface thereof, and a heat-insulating material formed around the corner member, the corner member comprising a fixed member secured to the inner surface of the corner of the storage tank, and a movable member supported on the fixed member to move linearly on the fixed member.

8. The LNG storage tank according to claim 7, wherein the corner member further comprises a connection member to connect and secure the movable member to the inner surface of the corner of the storage tank.

9. The LNG storage tank according to claim 8, wherein the fixed member and the connection member of the corner member are coupled at a plurality of locations to the inner surface of the corner of the storage tank.

10. The LNG storage tank according to claim 7, wherein the fixed member comprises a guide recess and the movable member comprises a guide protrusion, the movable member being linearly moved on the fixed member by the guide recess and the guide protrusion.

11. The LNG storage tank according to claim 10, wherein the guide protrusion is produced independent of the movable member, and integrally welded to the movably member to match a location of the guide recess of the fixed member after positioning the movable member on the fixed member.

* * * * *